US006369773B2

(12) United States Patent
Kashiwagi et al.

(10) Patent No.: US 6,369,773 B2
(45) Date of Patent: Apr. 9, 2002

(54) SHEET ANTENNA

(75) Inventors: Kenichi Kashiwagi, Tokyo; Yasukazu Nakata, Chiba; Hiroshi Yamamoto, Kanagawa; Kenji Nishio, Tokyo, all of (JP)

(73) Assignee: Lintec Corporation, Tokyo (JP)

( * ) Notice: Subject to any disclaimer, the term of this patent is extended or adjusted under 35 U.S.C. 154(b) by 0 days.

(21) Appl. No.: 09/725,682

(22) Filed: Nov. 30, 2000

(30) Foreign Application Priority Data

Nov. 30, 1999 (JP) ..... 11-339625

(51) Int. Cl.[7] ..... H01Q 1/32
(52) U.S. Cl. ..... 343/873; 343/700 MS
(58) Field of Search ..... 343/873, 713, 343/700 MS, 711, 872; 156/77, 78

(56) References Cited

U.S. PATENT DOCUMENTS 5,354,397 A * 10/1994 Miyake et al. ..... 156/77
6,087,996 A * 7/2000 Dery ..... 343/713

* cited by examiner

*Primary Examiner*—Don Wong
*Assistant Examiner*—James Clinger
(74) *Attorney, Agent, or Firm*—Sughrue Mion, PLLC

(57) ABSTRACT

A sheet antenna which comprises a substrate sheet, a layer of antenna element composed of a conductive material and a carbon-containing layer, the layer of antenna element and the carbon-containing layer being laminated on the substrate sheet is disclosed. The sheet antenna is superior in receiving and/or transmitting sensitivity of electric waves.

5 Claims, 3 Drawing Sheets

SHEET ANTENNA

BACKGROUND OF THE INVENTION

1. Field of the Invention

The present invention relates to a sheet antenna, which can be used for receiving or transmitting of electric waves. Particularly, the present invention relates to a sheet antenna, which can be used by adhering to surfaces of window glasses in motor vehicles and the like.

2. Description of Related Art

In recent years, it has been known to adhere sheet antennas containing an adhesive layer on surfaces of window glasses in motor vehicles in order to receive electric waves such as radio waves and television waves. The sheet antennas comprise a substrate sheet, a layer of antenna element composed of a conductive material formed on a surface of the substrate sheet and a adhesive layer formed on another surface of the substrate sheet.

However, there are some problems that the prior sheet antennas are poor in receiving or transmitting sensitivity of electric waves. Example of the problems is that images on television faceplates do not become visible when receiving television waves and therefore, it is difficult to watch the images. Accordingly, a sheet antenna having excellent receiving or transmitting sensitivity of electric waves is desired.

An object of the present invention is to provide a sheet antenna having excellent receiving or transmitting sensitivity of electric waves.

Extensive investigations undertaken by the present inventors directed to the object described above have led to the discovery that the receiving or transmitting sensitivity of electric waves can be increased by laminating the layer of antenna element composed of a conductive material and the carbon-containing layer on the substrate sheet.

The present invention, thus, provides a sheet antenna which comprises a substrate sheet, a layer of antenna element composed of a conductive material and a carbon-containing layer, the layer of antenna element and the carbon-containing layer being laminated on the substrate sheet.

In another aspect, the present invention provides a sheet antenna as described above, wherein an attaching layer is formed on a surface of the substrate sheet, in which the antenna element is formed, or the opposite surface.

In still another aspect, the present invention provides a sheet antenna as described above, wherein the attaching layer has removability and readhesiveness.

In further aspect, the present invention provides a sheet antenna as described above, wherein the attaching layer is an urethane elastomer layer having an elastic modulus at 100% elongation of not more than $6\times10^6$ N/m$^2$ and a breaking strength of not less than $2\times10^7$ N/m$^2$.

In furthermore aspect, the present invention provides a sheet antenna as described above, wherein a strong pressure-sensitive adhesive layer and a resin sheet are laminated on the substrate sheet, and the attaching layer is formed on a surface of the resin sheet.

DESCRIPTION OF PREFERRED EMBODIMENTS

Figure 1:
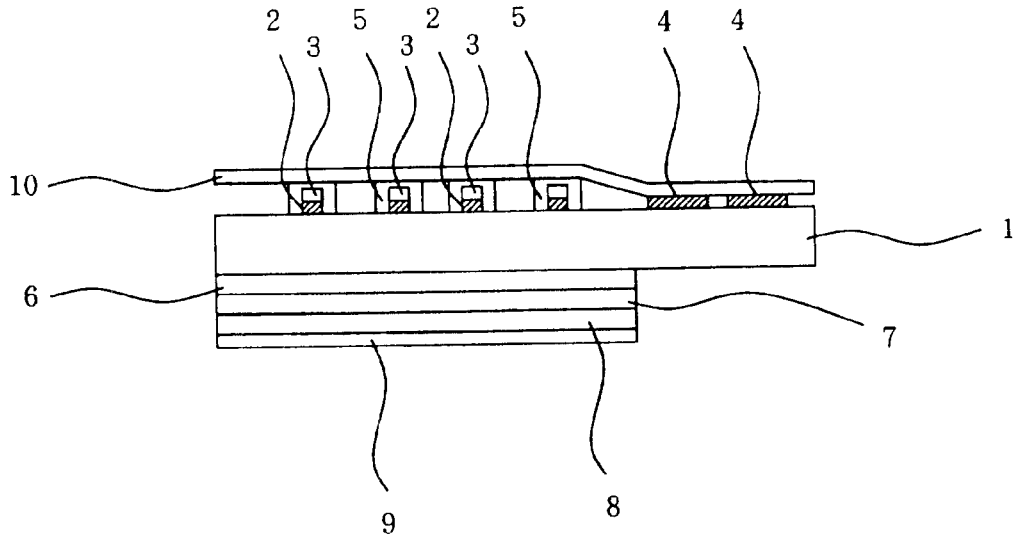
FIG. 1 shows a sectional view of a part of one embodiment in the sheet antenna of the present invention.
Figure 2:
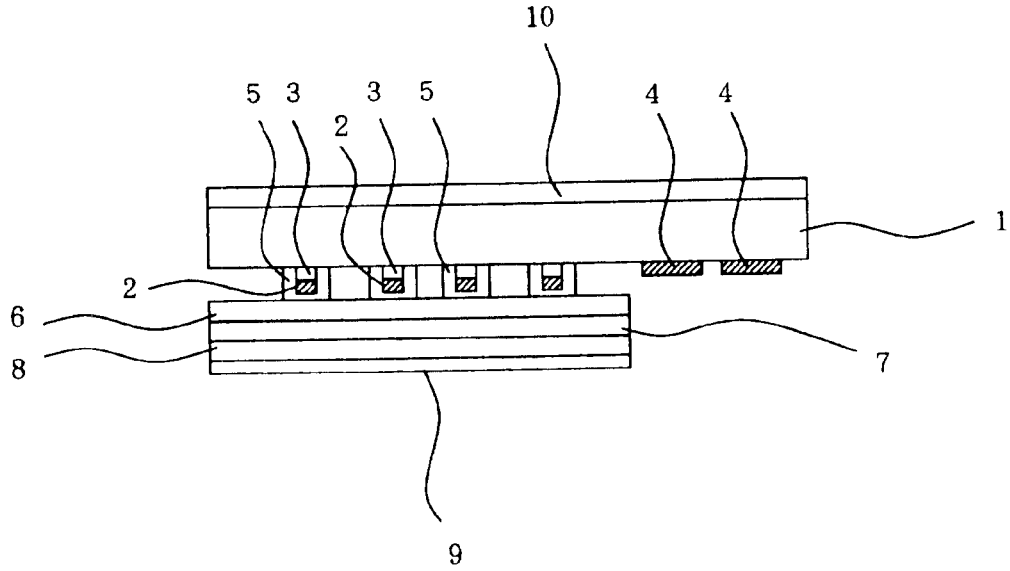
FIG. 2 shows a sectional view of a part of another embodiment in the sheet antenna of the present invention.
Figure 3:
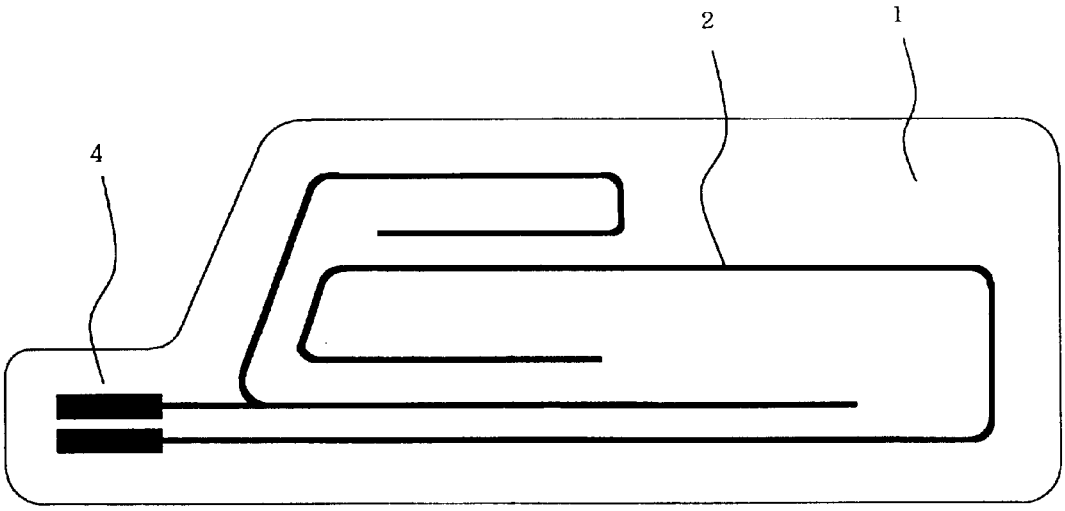
FIG. 3 shows a plan view of the shape of the antenna element and the terminal part in one embodiment of the sheet antenna of the present invention.

The sheet antenna of the present invention is explained based on FIG. 1, FIG. 2 and FIG. 3.

In the sheet antenna of the present invention, various plastic sheets and films can be used as the substrate sheet 1. Preferable examples are plastic sheets and films having heat resistance that the plastic sheets and films can resist the curing temperature in forming the antenna element with the conductive material. Examples of the plastic sheets and films include sheets and films of synthetic resins, such as polyolefins like polypropylene, polyesters like polyethylene terephthalate, polyethylene naphthalene and polybutylene terephthalate polyvinyl chlorides, polyurethanes, polycarbonates, polyamides, polyimides and fruororesins, preferably sheets and films of polyethylene terephthalate or polypropylene. The substrate sheet 1 can be composed of single layer or multi layers of two or more same kind or different kind layers.

The substrate sheet 1 is preferably transparent or translucent and more preferably transparent to obtain visibility of window glasses, since the substrate sheet 1 is adhered to window glasses in motor vehicles and the like.

The thickness of the substrate sheet 1 is not limited particularly, but the thickness of the substrate sheet 1 is in the range from usually 20 to 500 $\mu$m, preferably 40 to 250 $\mu$m.

The layer of antenna element 2 is composed of conductive material. The conductive material used in the layer of antenna element 2 includes, for example, conductive pastes in which particles of metal are dispersed in binder. Examples of the metal include gold, silver, nickel and copper.

Forming the layer of antenna element 2 on the substrate sheet 1 can be conducted by adhering the conductive paste to the substrate sheet 1 in antenna pattern shape by means of printing, applying and the like. The metal particle used in the conductive paste is more preferably silver particle. The average particle size of the metal particle is preferably in the range from 1 to 15 $\mu$m, more preferably in the range from 2 to 10 $\mu$m. Examples of the binder include polyester resins, polyurethane resins, epoxy resins and phenol resins. The ratio by weight of the metal particle to the binder is preferably in the range from 95:5 to 80:20, more preferably in the range from 93:7 to 85:15.

Solvent can be preferably added in the conductive paste to increase printing property, applying property and the like. The solvent includes general solvents.

The thickness of the conductive material layer formed with the conductive paste is in the range from preferably 3 to 50 $\mu$m, more preferably 8 to 20 $\mu$m in dried thickness.

Instead of the conductive paste, for example, metal simple substance such as metallic foil, vapor deposition film, thin metal film produced by sputtering and the like can be used as the conductive material. Examples of the metal simple substance include the metals used in the conductive paste and aluminum.

The resistivity of the conductive material layer is preferably in the range from $10^{-4}$ to $10^{-6}$ Ω·cm in value measured by four probe method of the resistivity measurement.

The shape of the antenna element 2 is not limited particularly so long as the shape has antenna performance capable to receive or transmit various electric waves for radio, television and portable telephone and the like, and includes that shown in FIG. 3.

The carbon-containing layer 3 is laminated on the layer of the antenna element 2.

As the carbon contained in the carbon-containing layer, various carbons such as graphite and carbon black can be used. Examples of the carbon is preferably a combination of graphite and carbon black. When the combination of graphite and carbon black is used, the content ratio of the graphite against to the total amount of carbon is not limited particularly, but in the range from preferably 50 to 80 percent by weight, more preferably 60 to 70 percent by weight. The shape of graphite is preferably a scale. The average particle size of graphite is in the range from preferably 1 to 10 μm, more preferably 2 to 8 μm. The average particle size of carbon black is in the range from preferably 0.01 to 3 μm, more preferably 0.5 to 2 μm and most preferably 0.1 to 1 μm.

The carbon-containing layer 3 contains preferably a binder.

Forming the carbon-containing layer 3 can be conducted by adhering the carbon paste, in which the carbon is dispersed in the binder, by means of printing, applying and the like.

As the binder, the same binders used in the conductive material described above can be used. Preferable examples are polyester resins.

The content amount of carbon in carbon-containing layer 3 is not limited particularly, but in the range from preferably 30 to 70 percent by weight, more preferably 40 to 60 percent by weight.

The resistivity of the carbon-containing layer 3 is in the range of preferably not more than $2.0\times10^{-1}$ Ω·cm, more preferably $0.8\times10^{-1}$ to $1.1\times10^{-1}$ Ω·cm.

The carbon paste contains preferably a solvent to increase printing property, applying property and the like. Examples of the solvent include general solvents.

The thickness of the carbon-containing layer 3 is in the range from preferably 1 to 30 μm, more preferably 2 to 20 μm, most preferably 3 to 15 μm in dried thickness.

The pattern of carbon-containing layer 3 is preferably almost similar to the pattern of antenna element 2. The carbon-containing layer 3 can be laminated on either upper or under of the antenna element 2, or both upper and under of the antenna element 2. The carbon-containing layer 3 can be wide or narrow in width than the width of the antenna element 2 pattern. When the carbon-containing layer 3 is wide in width than the width of the antenna element 2 pattern, the carbon-containing layer 3 can be arranged to coat either or both of end face of the antenna element 2. The carbon-containing layer 3 has preferably the almost same width as the antenna element 2.

The carbon-containing layer 3 can be directly laminated on the layer of the antenna element 2 or laminated through the substrate sheet 1 or some other layers on the layer of the antenna element 2. Preferably, the carbon-containing layer 3 is directly laminated on the layer of the antenna element 2.

The layer of antenna element 2 is preferably arranged to the side of outdoor or out of vehicle from the carbon-containing layer 3 when the antenna element 2 is fixed. When the sheet antenna is used for the motor vehicles, the sheet antenna is preferably composed to set the layer of the antenna element 2 in the side of the window glass and the carbon-containing layer 3 in the side of indoor, because the sheet antenna is usually fixed on inside surface of the window glass.

Thus, as described hereinafter, when the attaching layer 8 is set to the sheet antenna, the layer of antenna element 2 is preferably arranged in the side near to the attaching layer 8 and the carbon-containing layer 3 is arranged in the opposite side as FIG. 1 and FIG. 2. When the antenna element 2 is coated with the substrate sheet 1 and the carbon-containing layer 3, the pattern of the carbon-containing layer 3 is preferably composed not to contain the terminal part 4 because the end of the antenna element 2 is used as the terminal part 4 which connects a feeder line.

The surface of the formed antenna element 2 can be coated with a protective layer 5 such as a resist. The protective layer 5 is used for providing waterproof property, insulating property, abrasion resistance and the like to the antenna element 2. The protective layer 5 is preferably transparent as well as the substrate sheet 1.

Examples of the resist include resists formed with resist inks containing one member or a combination of two or more members of ultraviolet curable resins, thermosetting resins and the like, preferably ultraviolet curable resins.

Examples of the ultraviolet curable resins include one member or a mixture of two or more members of urethane acrylate resins, epoxy acrylate resins, polyester acrylate resins, polyether acrylate resins, polyol acrylate resins and epoxy resins. The ultraviolet curable resin is preferably mixed with a photoinitiator.

Examples of the thermosetting resins include one member or a mixture of two or more member of polyester resins, polyurethane resins, phenol resins, epoxy resins, vinyl resins and acrylic resins.

Coating with the resist ink can be conducted by the method such as printing, applying and the like. The resist can be applied to almost all surface of the substrate sheet 1 or can be coated to have a slight wide width than the antenna element 2. However, the resist is not coated on the terminal part 4 because of connection to the feeder line.

The terminal part 4 can connect to receiving devices or transmitting devices such as radio, television and navigation with a code such as feeder line.

The thickness of the protective layer 5 is generally in the range from preferably 1 to 30 μm, more preferably 5 to 20 μm.

The terminal part 4 is formed on the end part of the antenna element 2 in order to connect with an antenna feeder. The terminal part 4 is composed of a conductive material, which includes the same conductive materials as composed in the antenna element 2.

In the sheet antenna of the present invention, the attaching layer 8 is preferably formed on the surface of the substrate sheet 1 on which the antenna element 2 is formed, or the opposite surface.

Examples of materials used in the attaching layer 8 include urethane resins, acrylic resins, polyester resins and rubber resins, and preferably urethane resins composed of polyurethane elastomer.

In the present invention, the attaching layer 8 can have perpetual adhesiveness, but preferably removability and readhesiveness("repeat adhesiveness", in other words).

When the attaching layer 8 has removability and readhesiveness, the sheet antenna can be repeatedly removed easily from the adherend after the sheet antenna is adhered to the adherend and then adhered again to the adherend, whether the carbon-containing layer 3 is or not laminated on the antenna element 2.

The pressure-sensitive adhesive strength indicated by the attaching layer 8 having removability and readhesiveness, is in the range from preferably 0.03 to 5.0 N/25 mm, more preferably 0.07 to 0.5 N/25 mm.

The attaching layer 8 having removability and readhesiveness has preferably an elastic modulus at 100% elongation of preferably not more than $6\times10^6$ N/m$^2$, more preferably $2\times10^6$ to $4\times10^6$ N/m$^2$. When the elastic modulus at 100% elongation is more than $6\times10^6$ N/m$^2$, the adhesive strength to the adherend is too small and therefore it may be not able to adhere or readhere to the adherend. When the elastic modulus at 100% elongation is less than $2\times10^6$ N/m$^2$, the adherend may be stained in removing.

The breaking strength of the attaching layer 8 is preferably not less than $2\times10^7$ N/m$^2$, more preferably $3\times10^7$ to $1\times10^{8\ N/m^2}$. Further, the attaching layer 8 is preferably transparent.

In the present invention, the thickness of the attaching layer 8 is not limited particularly, but is in the range from usually 5 to 50 $\mu$m, preferably 8 to 25 $\mu$m.

In order to protect the attaching layer 8, release liner 9 can be laminated. As the release liner 9, conventional protecting sheets having a high smooth surface can be used to maintain, for example, smoothness of the attaching layer 8.

Examples of such release liner 9 include preferably release liners release-treated to mirror treating-coated papers, mirror treated and polyolefin melt extruding-coated papers and release liners release-treated thereof, synthetic resin films having a high smooth surface such as polyethylene terephthalate films and polypropylene films and release liners release-treated thereof. As the release treatment, conventional release treatment can be used. Examples of the releasing agent include silicone resins, alkyd resins, silicone/alkyd copolymer resins, polyethylene resins, polypropylene resins, mixtures of polyethylene and polypropylene resins and mixtures of silicone/PVA polyvinyl alcohol acetate. The thickness of such release liner 9 is not limited, but preferably in the range of 25 to 200 $\mu$m.

The attaching layer 8 can be formed directly or through some layers to the surface of the substrate sheet 1.

The sheet antenna of the present invention can be preferably produced by laminating the substrate sheet 1 with a laminated sheet at the surface of the substrate sheet 1 in which the antenna element 2 and the terminal part 4 are formed, or the opposite surface in view of easy production, wherein the substrate sheet 1 comprises the antenna element 2 laminated with the carbon-containing layer 3 and the terminal part 4 formed on one surface of the substrate sheet 1, and the laminated sheet comprises the attaching layer 8 formed on one surface of another resin sheet 7 and strong pressure-sensitive layer 6 formed on another surface of the resin sheet 7. Accordingly, in this case, the sheet antenna is composed of the strong pressure-sensitive layer 6 and the resin sheet 7 in order laminated on the substrate sheet 1 and the attaching layer 8 formed on the surface of the resin sheet 7. Thus, the attaching layer 8 is formed on one surface of the substrate sheet 1 through the strong pressure-sensitive layer 6 and the resin sheet 7. Such laminated sheet can be adhered on all surface or the surface removing a part of the substrate sheet 1 on which the antenna element 2 and the terminal part 4 are formed. For example, adhering the laminated sheet on all surface of the substrate 1 except for the position of the terminal part 4 is preferable because of easy connection to the antenna feeder.

Examples of strong pressure-sensitive adhesive used in the strong pressure-sensitive adhesive layer 6 include natural rubber pressure-sensitive adhesives, synthetic rubber pressure-sensitive adhesives, acrylic resin pressure-sensitive adhesives, polyvinyl ether resin pressure-sensitive adhesives, urethane resin pressure-sensitive adhesives and silicone resin pressure-sensitive adhesives. The strong pressure-sensitive adhesive layer 6 is preferably transparent as well as the substrate sheet 1.

The thickness of the strong pressure-sensitive adhesive layer 6 is not limited particularly, but is in the range from usually 10 to 200 $\mu$m, preferably 15 to 40 $\mu$m.

The pressure-sensitive strength of the strong pressure-sensitive adhesive layer 6 is preferably three times or more of that of the attaching layer 8.

The resin sheet 7 includes the same sheets as the substrate sheet 1. The resin sheet 7 is preferably transparent. The thickness of the resin sheet 7 is not limited particularly, but is in the range from preferably 10 to 100 $\mu$m.

The attaching layer 8 and the strong pressure-sensitive adhesive layer 6 can be formed by any one of various methods. The methods are not limited particularly and include, for example, air knife coater, blade coater, bar coater, gravure coater, roll coater, curtain coater, die coater, knife coater, screen coater, Myer bar coater, kiss coater and the like.

In the present invention, an ultraviolet absorber can be contained in any one or not less than 2 layers of the substrate sheet 1, the attaching layer 8, the strong pressure-sensitive adhesive layer 6 and the resin sheet 7.

Examples of the ultraviolet absorber include benzophenone type ultraviolet absorbers such as 2-hydroxy-4-methoxy benzophenone, 2-hydroxy-4-octoxy benzophenone, 2,2'-dihydroxy-4-methoxy benzophenone; salicylic acid ester type ultraviolet absorbers such as phenyl salycilate, p-tert-butyl phenyl salycilate and p-octylphenyl salycilate; benzotriazole type ultraviolet absorbers such as 2-(2'-hydroxy-5'-methylphenyl) benzotriazole, 2-(2'-hydroxy-5'-tert-butylphenyl) benzotriazole and 2-(2'-hydroxy-3',5'-di-tert-butylphenyl) benzotriazole; and cyanoacrylate type ultraviolet absorbers such as 2-ethylhexyl-2-cyano-3,3'-diphenyl acrylate and ethyl-2-cyano-3,3'-diphenyl acrylate.

The content amount of the ultraviolet absorber is preferably in the range from 0.2 to 5 parts by weight against to 100 parts by weight of the material composed in any one layer.

The sheet antenna of the present invention can be adhered on various places such as window glasses of motor vehicles.

The surface of the sheet antenna can be covered with a protecting film 10. The protecting film 10 is used to protect the surface of the sheet antenna as the surface is not stained until a user adheres the sheet antenna to an adherend since the sheet antenna is produced. When the sheet antenna of the present invention is used as an antenna, the protecting film 10 is peeled.

Examples of the protecting film 10 include films applied with a removable pressure-sensitive adhesive to the sheets described as the substrate sheet 1. The total thickness of the protecting film 10 is not limited particularly, but is in the range from usually 10 to 100 $\mu$m, preferably 20 to 60 $\mu$m.

EXAMPLES

The present invention is described more specifically by reference to embodiments thereof. It should be noted that the present invention is not intended to be limited by these embodiments.

Example 1

On one surface of a transparent plastic film as substrate sheet 1 composed of a transparent polyethylene terephthalate resin film having a thickness of 125 μm, conductive paste comprising 90 parts by weight of silver particle having an average particle size of 5 to 7 μm as conductive material particle, 10 parts by weight of polyester resin as binder and 20 parts by weight of 2-butoxyethyl acetate as solvent was screen printed in pattern having a width of about 1 mm of the antenna shape as shown in FIG. 1 by a screen printing machine to form antenna element 2 having a dried thickness of 10 μm and a resistivity of $2.8\times10^{-5}$ Ω·cm and terminal part 4 to the end part of the antenna element 2. Next, carbon paste comprising 50 parts by weight of carbon particle prepared by mixing scale graphite having an average particle size of 4.5 μm and carbon black having an average particle size of 0.5 μm in the weight ratio of 6:4, 50 parts by weight of polyester resin as binder and 100 parts by weight of 2-(2-butoxyethyl)ethyl acetate as solvent was screen printed directly on the antenna element 2 in the same width and the same pattern except for terminal part 4 to laminate carbon-containing layer 3 having a dried thickness of 5 μm and a resistivity of $1.0\times10^{-1}$ Ω·cm on the antenna element 2.

Further, for purposes of waterproof and insulation, resist ink comprising a mixture of urethane acrylate and epoxy acrylate was applied on the carbon-containing layer 3 in a broader width than the pattern width of the antenna element 2, i.e., about 2 mm, except for the terminal part 4 to form protecting layer 5 having a thickness of 3 μm. Furthermore, protecting film 10 composed of a polypropylene film applied with removable rubber pressure-sensitive adhesive having a total thickness of 40 μm was covered on the substrate sheet 1, on which the antenna element 2 and the terminal part 4 were formed, to prepare the substrate sheet containing the antenna element and carbon-containing layer.

On the other hand, on one surface of a transparent plastic film as resin sheet 7 composed of a transparent polyethylene terephthalate resin film having a thickness of 25 μm, solution of urethane elastomer comprising 100 parts by weight of polyether urethane resin solution (produced by DAINICHISEIKA COLOR & CHEMICALS MFG.CO., LTD.), 8 parts by weight of isocyanate crosslinking agent (produced by DAINICHISEIKA COLOR & CHEMICALS MFG.CO., LTD.), 3 parts by weight of crosslink promoting agent (produced by DAINICHISEIKA COLOR & CHEMICALS MFG.CO., LTD.) and 100 parts by weight of ethyl acetate was applied by a knife coater and then cured and dried at 100° C. for 1 minute to form attaching layer 8 having a dried thickness of 10 μm, an pressure-sensitive adhesive strength of 0.15 N/25 mm, an elastic modulus at 100% elongation of $2.5\times10^{6}$ N/m$^2$ and a breaking strength of $4\times10^{7}$ N/m$^2$ . Further, release liner 9 composed of a polyethylene terephthalate film coated with alkyd resin having a thickness of 38 μm was laminated on the attaching layer 8. Next, on another surface of the resin sheet 7 on which the attaching layer 8 was not formed, pressure-sensitive adhesive composition prepared by mixing pressure-sensitive adhesive comprising acrylic pressure-sensitive adhesive as resin component and 2,2'-dihydroxy-4-methoxybenzophenone as ultraviolet absorber in the mixing ratio of 0.2 part by weight of ultraviolet absorber against to 100 parts by weight of the pressure-sensitive adhesive solid component was applied by a knife coater to form acrylic strong pressure-sensitive layer 6 having a dried thickness of 20 μm and a pressure-sensitive adhesive strength of 10 N/25 mm. As the result, a laminated sheet containing the attaching layer and the strong pressure-sensitive adhesive layer was prepared.

The one surface of the substrate sheet containing the antenna element on which the antenna element 2 and the terminal part 4 were not formed, was adhered to the surface of the strong pressure-sensitive layer 6 of the laminated sheet except for the position of the terminal part 4 to prepare a sheet antenna having a structure as shown in FIG. 1.

Example 2

The same method as described in Example 1 was conducted except that the substrate sheet containing the antenna element and the carbon-containing layer was prepared by screen printing in the order of carbon paste, conductive paste and resist ink to the substrate sheet 1, and adhering the protecting film 10 to the surface of the substrate sheet 1 on which the antenna element 2 was not formed.

The one surface of the substrate sheet containing the antenna element and the carbon-containing layer on which the antenna element 2 was formed, was adhered to surface of the strong pressure-sensitive layer 6 of the laminated sheet used in Example 1 as the terminal part 4 was not covered, to prepare a sheet antenna having a structure as shown in FIG. 2.

The sheet antennas prepared by Examples 1 and 2 were adhered to the indoor side of a rear window in passenger car. And then, a diversity antenna kit part was removed from a television tuner and monitor for car (trade name NVA9500F produced by CRARION Co., Ltd.) and the sheet antennas prepared by Examples 1 and 2 were connected to the television tuner and monitor. The sheet antennas prepared by Examples 1 and 2 were received with television waves (VHF CH 1, 3 and 4). The evaluation was conducted according to the subjective evaluation of 5 levels evaluation scale described as the following Table 1 and pages 6 to 7 of a NHK television technology textbook second volume in two volumes published by Nippon Hoso Shuppan Kyokai having a publishing date of Dec. 10, 1996 and being 8th copy. The sheet antenna of Example 2 had the same value as that of the sheet antenna of Example 1. The average value of 10 times evaluations of the sheet antenna of Example 1 was shown in FIG. 4.

Also, after the sheet antennas were repeatedly adhered and peeled over 10 times, the sheet antennas could be readhered and removed. And the window glass of the adherend was not stained.

TABLE 1

| 5 levels evaluation | Scale of image property and sound property |
|---|---|
| 5 | Very good |
| 4 | Good |
| 3 | Ordinary |
| 2 | Poor |
| 1 | Very poor |

Reference Example 1

A sheet antenna was prepared according to the same method as described in Example 1 except that the carbon-containing layer 3 was not formed in Example 1. The prepared sheet antenna was adhered on indoor side of the rear window in the passenger car and the evaluation of electric wave receiving sensitivity was conducted according to the same method as Example 1. The average value of 10 times evaluations was shown in FIG. 4.

Figure 4:
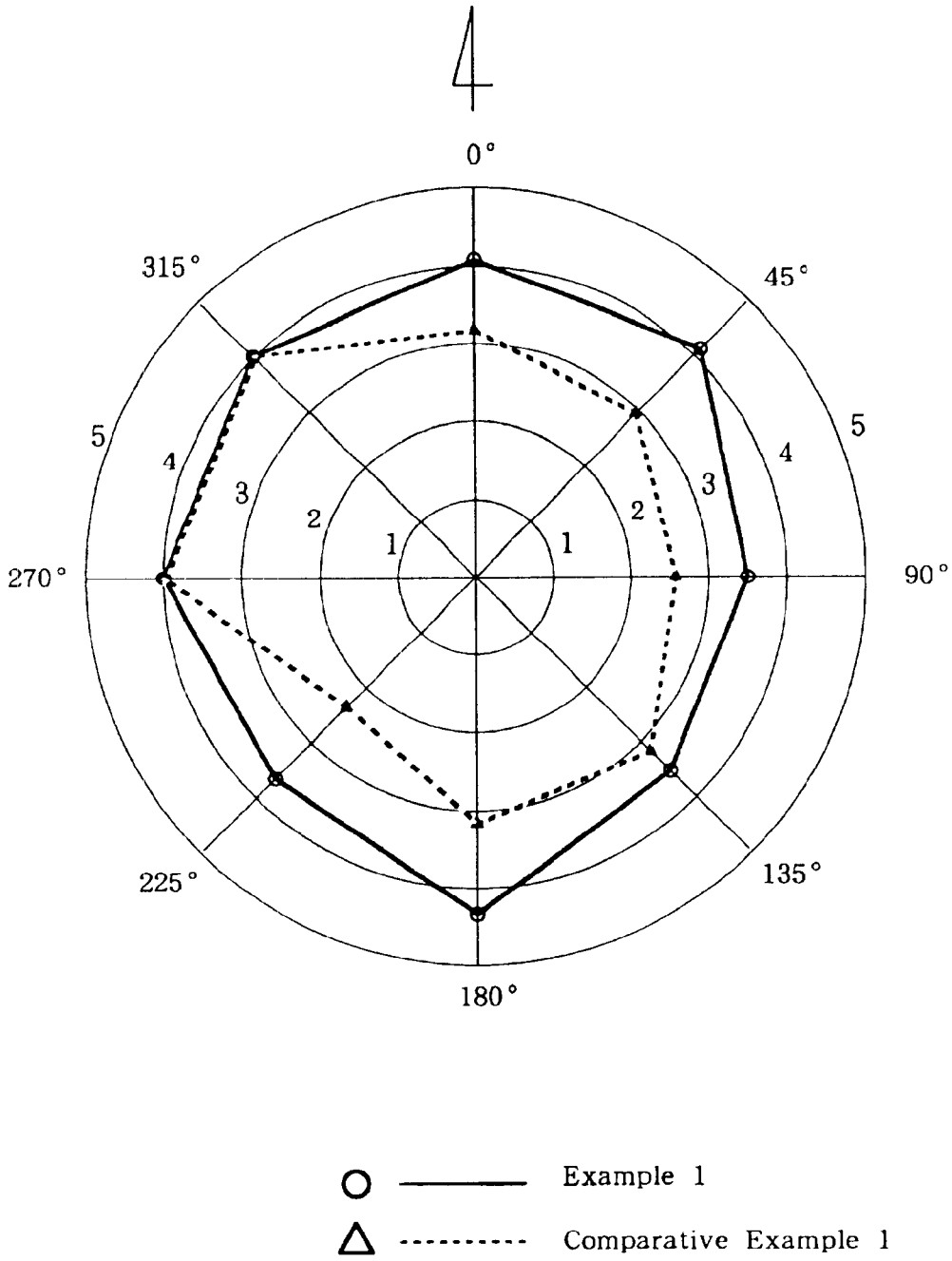
FIG. 4 shows a figure that ten times average values of 5 levels evaluation about receiving sensitivity of electric waves in all directions in one embodiment of the sheet antenna of the present invention and the sheet antenna of the comparative example are shown.

FIG. 4 shows that most external circle of concentric circles indicated 5 in 5 levels evaluation and inside circle indicates lower evaluation than near external circle by 1 as the circle becomes inside circle one by one in order, and most inside circle indicates 1 in 5 levels evaluation. The values of angle added in the concentric circles show directions of the compass that the side of rear window in the passenger car indicates and a direction angle of the compass as the angle of just north is 0. Thus, FIG. 4 shows the average value of 10 times in 5 levels evaluation of sheet antennas about receiving sensitivity of electric waves which are measured at all angles by rotating the passenger car by 45°.

The results shown in FIG. 4 indicate that the sheet antenna 1 is superior in receiving sensitivity of television waves compared with the sheet antenna of Comparative Example 1.

The sheet antenna of the present invention exerts the effect of high sensitivity in receiving and/or transmitting of electric waves.

What is claimed is:

1. A sheet antenna comprising a substrate, a layer of antenna element composed of a conductive material and a carbon-containing layer, the layer of antenna element being laminated on the substrate sheet and the carbon-containing layer being laminated on a surface of the layer of the antenna element except for a terminal part of the antenna element.

2. The sheet antenna as set forth in claim 1 wherein an attaching layer is formed on a surface of the substrate sheet.

3. The sheet antenna as set forth in claim 2 wherein the attaching layer has removability and readhesiveness.

4. The sheet antenna as set forth in claim 1 wherein the attaching layer is a urethane elastomer layer having an elastic modules at 100% elongation of not more than $6\times10^6 N/m^2$ and a breakthrough strength of not less than $2\times10^7 N/m^2$.

5. The sheet antenna as set forth in claim 2 wherein a strong pressure-sensitive adhesive layer and a resin sheet are laminated on the substrate sheet, and the attaching layer is formed on a surface of the resin sheet.

* * * * *

UNITED STATES PATENT AND TRADEMARK OFFICE

CERTIFICATE OF CORRECTION

PATENT NO. : 6,369,773 B2
DATED : April 9, 2002
INVENTOR(S) : Kenichi Kashiwagi et al.

It is certified that error appears in the above-identified patent and that said Letters Patent is hereby corrected as shown below:

Title page,
Item [73], Assignee, should read as follows:
-- [73] Assignee: Lintec Corporation and Keiyo Engineering Co., Ltd., both of Tokyo (JP) --

Signed and Sealed this

Third Day of June, 2003

JAMES E. ROGAN
*Director of the United States Patent and Trademark Office*